US006789763B2

(12) United States Patent
Ben-Ari

(10) Patent No.: US 6,789,763 B2
(45) Date of Patent: Sep. 14, 2004

(54) METHOD FOR OPERATING AN AIR-TO-AIR MISSILE AND CORRESPONDING MISSILE WITH AUTONOMOUS OR SEMI-AUTONOMOUS MODES

(75) Inventor: Tsafrir Ben-Ari, Shimshit (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 154 days.

(21) Appl. No.: 10/002,150

(22) Filed: Dec. 5, 2001

(65) Prior Publication Data

US 2002/0070311 A1 Jun. 13, 2002

(30) Foreign Application Priority Data

Dec. 7, 2000 (IL) ..... 140183

(51) Int. Cl.[7] ..... F41G 7/00

(52) U.S. Cl. ..... 244/3.15; 244/3.1; 244/3.16; 244/3.19; 342/62

(58) Field of Search ..... 244/3.1, 3.15, 244/3.16–3.22, 3.11–3.14; 342/61, 62, 63, 64, 65

(56) References Cited

U.S. PATENT DOCUMENTS

| | | | | |
|---|---|---|---|---|
| 3,617,015 A | * | 11/1971 | Kinder | 244/3.14 |
| 4,146,196 A | * | 3/1979 | Schultz | 244/3.1 |
| 5,094,406 A | * | 3/1992 | Shafer | 244/3.21 |
| 5,931,874 A | | 8/1999 | Ebert et al. | |

FOREIGN PATENT DOCUMENTS

| | | | | |
|---|---|---|---|---|
| DE | 19716025 A1 | | 10/1998 | |
| EP | 0276099 A2 | | 7/1988 | |
| JP | 052642000 A | * | 10/1993 | 244/3.15 |

* cited by examiner

*Primary Examiner*—Bernarr E. Gregory
(74) *Attorney, Agent, or Firm*—Mark M. Friedman

(57) ABSTRACT

A method for operating a short range, air-to-air missile carried by an aircraft flown by a pilot. The missile includes a seeker operative to track a target. The method comprises providing a first indication to the pilot when the seeker is tracking a target, providing a second indication to the pilot when a rate of angular motion of the seeker falls below a given value for a predefined period.

30 Claims, 8 Drawing Sheets

METHOD FOR OPERATING AN AIR-TO-AIR MISSILE AND CORRESPONDING MISSILE WITH AUTONOMOUS OR SEMI-AUTONOMOUS MODES

FIELD AND BACKGROUND OF THE INVENTION

The present invention relates to air-to-air missiles and, in particular, it concerns methods for operating such missiles for targets outside the field-of-view of a radar system, or independent of the presence of a radar system.

The extremely high speed of modern air-to-air combat stretches the capabilities of a human pilot to their limits. Faced with complex aircraft instrumentation and high-tech weapon systems, a pilot is required to achieve split-second reaction times as supersonic aircraft pass each other at relative speeds up to thousands of miles per hour. Various high performance target-seeking air-to-air missiles have been developed to operate under these conditions. However, many factors generally limit the usefulness of such missiles to greatly less than their theoretical performance capabilities.

Specifically, and with reference to FIGS. 1 and 2, it should be noted that operation of air-to-air missiles is generally integrated with a radar system of an aircraft. A typical sequence of operation is illustrated in the left portion of FIG. 1 as follows. First, at step 10, the radar detects (acquires) a target and, usually under the control of the pilot, directs the seeker of the missile to track the target (step 12). Once both the radar and the missile seeker are locked-on to a target, the two tracking directions are typically displayed to the pilot superimposed on a display, thereby allowing the pilot to verify visually that the missile is successfully tracking the intended target (step 14). Advantageously, information about the target, such as range-derived data from the radar measurements and tracking direction information, together with predefined information regarding the performance limitations of the missile and flight data from the aircraft systems are processed to determine whether a number of criteria indicative of the capability of the missile to reach the target are satisfied (step 16). This information is typically represented graphically on a head-up-display (HUD) combined with data from the radar, allowing visual interpretation by the pilot of whether the target is within the maximum range and other performance limitations of the missile prior to firing.

Although the close integration of missile operation with the radar system provides very effective operation within the field-of-view of the radar, it also leads to severe limitations outside that range. Thus, as shown in the right portion of FIG. 1, target acquisition through the radar system is clearly not possible outside the field-of-view of the radar system (10'). In the event that a target is initially acquired by the radar system while within its field-of-view, the tracking of step 12 may continue outside the radar field-of-view (12'). However, the target verification is no longer available (14') with the result that the pilot cannot be sure that the missile is in fact tracking the intended target. Similarly, the calculation of performance limitations criteria ceases (16') as soon as the target leaves the radar field-of-view such that the pilot lacks all indications as to whether the missile is capable of reaching the intended target.

The significance of these limitation will be better appreciated with reference to FIG. 2. As shown here, the field-of-view 18 of the radar system of a combat aircraft does not generally extend more than 60° above the boresight direction, and is frequently limited in practice to nearer 30°. In contrast, the field-of-view 20 of the seeker of a high performance air-to-air missile is generally much wider, in many cases lying in the 80°–90° range. As a result, in very many cases, a target may be inaccessible despite being visible to the pilot and within the capabilities of the missile to track and destroy.

One example in which the large blind region of the radar system presents a critical limitation to operation of air-to-air missiles relates to what is known as the "vertical mode". A predominant course of action in air-to-air combat situations is for the pilot to pull the nose of the aircraft "up" (in the pilot's frame of reference) so as to draw the nose towards a target. In this case, the target is generally visible to the pilot at a high angle above his head and, by continuing to pull the nose up, the pilot attempts to reduce this angle to bring the target more in front of him. A "vertical mode" seeks to acquire a target located "upwards" in the pilot's frame of reference to allow the pilot to fire a missile at the earliest possible opportunity. However, a vertical mode based upon the radar system is once again limited to the low angle of inclination covered by the radar, thereby greatly delaying acquisition of the target.

One approach to facilitating target acquisition and verification outside the field-of-view of the radar system is by use of a helmet-mounted cueing system. This employs a magnetic or an optical system to monitor the position of a helmet provided with a helmet-mounted head-up display. In this case, in a cueing mode, the missile seeker is enslaved to follow an optical axis of the display which moves together with the helmet. Cueing is achieved by the pilot turning his head, and hence the helmet, to bring the optical axis into alignment with the target.

While providing a partial solution to the problem of target acquisition and verification, helmet-mounted displays and cueing systems suffer from a large number of disadvantages. Firstly, the components mounted in the helmet add greatly to the weight of the helmet This weight becomes multiplied numerous times under high-acceleration conditions, becoming a major source of fatigue and stress for the pilot. Secondly, these systems generally require alignment of the optical axis of the helmet with the target to be designated. Although this can be achieved over a range of angles beyond the radar field-of-view, operation of the system is still limited by the angular range of helmet motion which the pilot can achieve, which is typically smaller than the actual field of view both of the pilot and of the seeker. Furthermore, shifting of the entire head together with the heavy helmet to the required angle under high acceleration conditions may require great effort, and may cause significant delay in the cueing procedure. Thirdly, the helmet-mounted display typically requires very substantial connections between the helmet and other devices within the aircraft. These connections generally include a significant power supply and electrical and/or optical fibers for carrying projected information for the display. Such connections pose a significant safety hazard for the pilot, particularly with respect to emergency ejection where a special guillotine is required to sever the connections in case of emergency. The supply of a high voltage power line to within the helmet is also viewed as a particular safety hazard. Fourthly, the addition of helmet-mounted displays and cueing systems fails to provide any indication to the pilot regarding the capability of the missile to reach the target when the target lies outside the radar field-of-view. Finally, the integration of a head mounted display and cueing system into the aircraft systems is a highly expensive project, requiring adaptation of numerous subsystems, with all the complications of safety and reliability evaluation procedures and the like which this entails.

There is therefore a need for methods of operating an air-to-air missile which would allow effective operation of the missile with respect to targets lying outside the radar field-of-view, or altogether independent of a radar system, without requiring use of a helmet-mounted display. It would also be highly advantageous to provide a missile configured to provide effective modes of operation with respect to targets lying outside the radar field-of-view, or altogether independent of a radar system.

SUMMARY OF THE INVENTION

The present invention is a method for operating a short range, air-to-air missile, and a corresponding missile.

According to the teachings of the present invention there is provided, a method for operating a short range, air-to-air missile carried by an aircraft flown by a pilot, the missile having a seeker operative to track a target, the method comprising: (a) providing a first indication to the pilot when the seeker is tracking a target; and (b) providing a second indication to the pilot when a rate of angular motion of the seeker falls below a given value for a predefined period.

According to a further feature of the present invention, the first indication and the second indication are readily distinguishable audible signals.

There is also provided, according to the teachings of the present invention, a method for operating a short range, air-to-air missile carried by an aircraft flown by a pilot, the missile having a seeker configured to track a target, the method comprising: (a) providing a signaling unit associated with the missile and configured to provide a first indication to the pilot when the seeker is tracking a target and to provide a second indication to the pilot when a rate of angular motion of the seeker falls below a given value for a predefined period; and (b) while the seeker is tracking a target visible to the pilot, flying the aircraft in such a manner that the direction of a line of sight from the pilot to the target remains substantially constant in a frame of reference moving with the aircraft for the predefined period, thereby causing the signaling unit to generate the second indication.

There is also provided, according to the teachings of the present invention, a short range, air-to-air missile to be carried by an aircraft flown by a pilot, the missile comprising: (a) a gimbaled seeker configured to track a target; (b) a processing system including at least one processor, the processing system being configured to provide a first indication to the pilot when the seeker is tracking a target; (c) wherein the processing system is further configured to provide a second indication to the pilot when a rate of angular motion of the seeker falls below a given value for a predefined period.

There is also provided, according to the teachings of the present invention, a short range, air-to-air missile to be carried by an aircraft flown by a pilot, the missile comprising: (a) a gimbaled seeker configured to track a target, the gimbaled seeker having a direction of regard defined by an angle of inclination $\theta$ from a predefined boresight direction and an orientation angle $\phi$ measured about an axis corresponding to the boresight direction, the angle of inclination $\theta$ being limited by a predefined maximum angle $\theta_{max}$; and (b) a processing system including at least one processor associated with the seeker, the processing system being configured to: (i) process the angle of inclination while the seeker is tracking a target to derive a rate of change of the angle of inclination $\dot{\theta}$, (ii) evaluate an off-boresight tracking angle limitation parameter as a function of both the angle of inclination and the rate of change, and (iii) generating a tracking angle exceedance signal when the off-boresight tracking angle limitation parameter falls outside a predefined range.

According to a further feature of the present invention, the processing system is configured to evaluate the off-boresight tracking angle limitation parameter P according to a relation $P=\theta+t_0\dot{\theta}$ where $t_0$ is a predefined measure of time taken after firing for the missile to begin to turn, and wherein the processing system is configured to generate the tracking angle exceedance signal when P is greater than $\theta_{max}$.

According to a further feature of the present invention, the processing system is configured to generate the tracking angle exceedance signal as an electric signal corresponding to a distinctive audio output.

There is also provided, according to the teachings of the present invention, a short range, air-to-air missile to be carried by an aircraft flown by a pilot, the missile comprising: (a) a gimbaled seeker having a direction of regard defined by an angle of inclination $\theta$ from a predefined boresight direction and an orientation angle $\phi$ measured about an axis corresponding to the boresight direction; and (b) a processing system including at least one processor associated with the seeker, the processing system being configured: (i) to selectively actuate the seeker to perform a scanning search pattern for a target, the scanning search pattern being confined to a range of orientation angles spanning no more than 20° and covering a range of inclination angles spanning no less than 30°, and (ii) when a target is found, to cause the seeker to track the target.

According to a further feature of the present invention, the scanning search pattern covers a range of inclination angles spanning no less than 50°.

According to a further feature of the present invention, the angle of inclination $\theta$ is limited by a predefined maximum angle $\theta_{max}$, the scanning search pattern covering a range of inclination angles extending substantially up to the predefined maximum angle $\theta_{max}$.

According to a further feature of the present invention, the scanning search pattern is confined to a range of orientation angles spanning no more than 10°, and preferably spanning between 5° and 10°.

According to a further feature of the present invention, there are also provided attachment features configured to define an orientation of attachment of the missile to an aircraft such that, when attached to an aircraft, a given value of seeker orientation angle $\phi_v$ corresponds to a "vertical" direction in an aircraft frame of reference, wherein the scanning search pattern is confined to a range of orientation angles of $\phi_v \pm 5°$.

There is also provided, according to the teachings of the present invention, a method for operating a short range, air-to-air missile carried by an aircraft flown by a pilot, the missile including a gimbaled seeker having a direction of regard defined by an angle of inclination $\theta$ from a predefined boresight direction and an orientation angle $\phi$ measured about an axis corresponding to the boresight direction, the method comprising: (a) causing the seeker to perform a scanning search pattern for a target, the scanning search pattern being confined to a range of orientation angles spanning no more than 20° and covering a range of inclination angles spanning no less than 30°, and (b) when a target is found, causing the seeker to track the target.

According to a further feature of the present invention, the scanning search pattern covers a range of inclination angles spanning no less than 50°.

According to a further feature of the present invention, the angle of inclination $\theta$ is limited to a predefined maximum angle $\theta_{max}$, the scanning search pattern covering a range of inclination angles extending substantially up to the predefined maximum angle $\theta_{max}$.

According to a further feature of the present invention, the scanning search pattern is confined to a range of orientation angles spanning no more than 10°, and preferably spanning between 5° and 10°.

According to a further feature of the present invention, the scanning search pattern is confined to a range of orientation angles of $\phi_v \pm 5°$ where $\phi_v$ corresponds to a vertical direction in the aircraft frame of reference.

There is also provided, according to the teachings of the present invention, a method for operating a short range, air-to-air missile carried by an aircraft flown by a pilot, the missile including a gimbaled seeker having a direction of regard defined by an angle of inclination $\theta$ from a predefined boresight direction and an orientation angle $\phi$ measured about an axis corresponding to the boresight direction, the angle of inclination $\theta$ being limited by a predefined maximum angle $\theta_{max}$, the method comprising: (a) processing the angle of inclination while the seeker is tracking a target to derive a rate of change of the angle of inclination $\dot{\theta}$; (b) evaluating an off-boresight tracking angle limitation parameter as a function of both the angle of inclination and the rate of change; and (c) generating a tracking angle exceedance signal when the off-boresight tracking angle limitation parameter falls outside a predefined range.

According to a further feature of the present invention, at least the steps of processing and evaluating are performed by a processing system located within the missile.

According to the teachings of the present invention, in an aircraft carrying a short range, air-to-air missile having a seeker configured to track a target within a missile field-of-view, the aircraft including a radar system which provides range-derived data relating to targets within a radar field-of-view smaller than the missile field-of-view, there is also provided a method for evaluating whether the missile will be effective in reaching a target comprising the steps of: (a) during a first period when a given target lies within the radar field-of-view, evaluating at least one performance limitation criterion relating to the ability of the missile to reach the given target, the performance limitation criterion being evaluated using the range-derived data for the given target; and (b) during a second period subsequent to the given target leaving the radar field-of-view, evaluating the performance limitation criterion using approximate range-derived data for the given target, the approximate range-derived data being derived by extrapolation from range-derived data provided by the radar system during the first period.

According to a further feature of the present invention, the approximate range-derived data is derived by extrapolation based upon an assumption that a speed of the given target derived from radar measurements during a latter portion of the first period remains constant.

According to a further feature of the present invention, the performance limitation criterion is additionally evaluated using target direction information related to a direction from the aircraft to the given target, wherein the target direction information is derived, at least during the second period, from tracking information provided by the missile seeker.

According to a further feature of the present invention, the evaluating is performed, at least during the second period, by a processing system located within the missile.

According to a further feature of the present invention, an audible indication audible to a pilot of the aircraft is selectively generated, dependent upon results of evaluating the at least one performance limitation criterion.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a method for operating a short range, air-to-air missile, and a corresponding missile.

The principles and operation of methods and devices according to the present invention may be better understood with reference to the drawings and the accompanying description.

Figure 1:
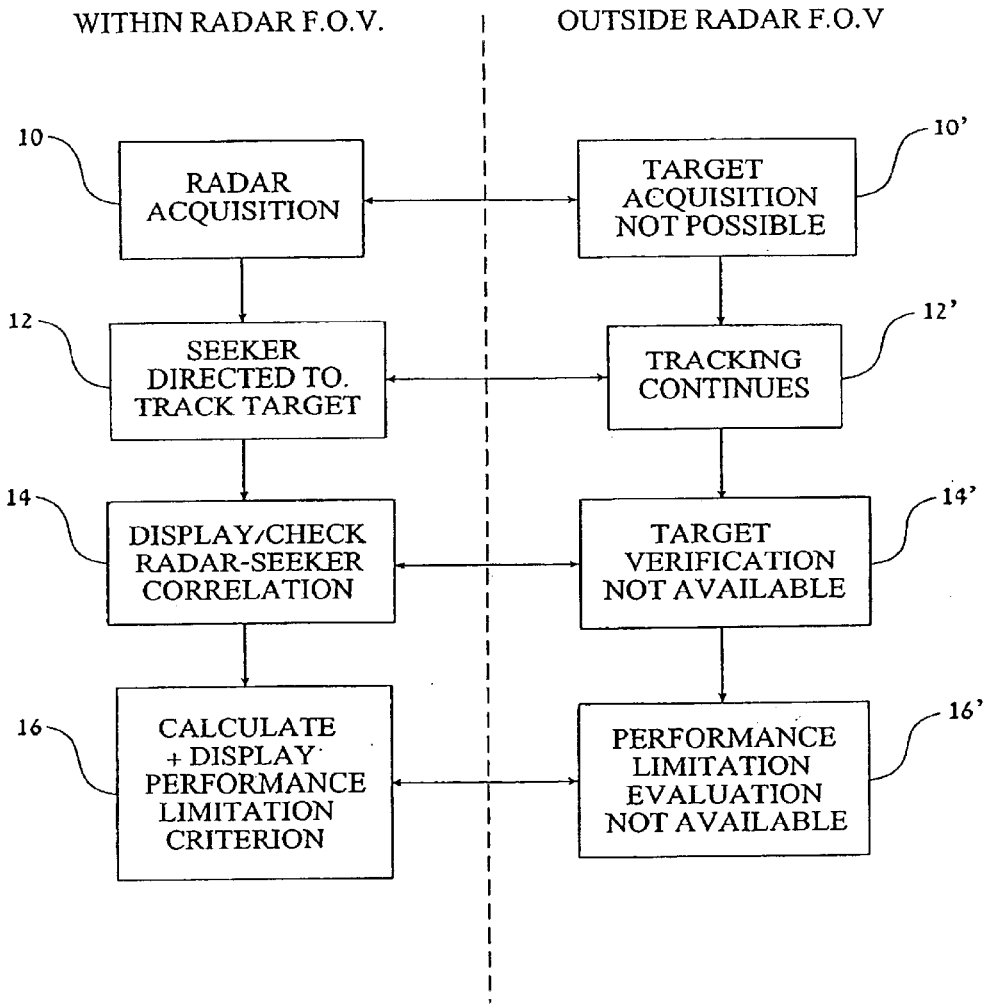
FIG.1 (PRIOR ART)
FIG. 1 is a flow diagram illustrating conventional radar-based operation of an air-to-air missile.
Figure 2:
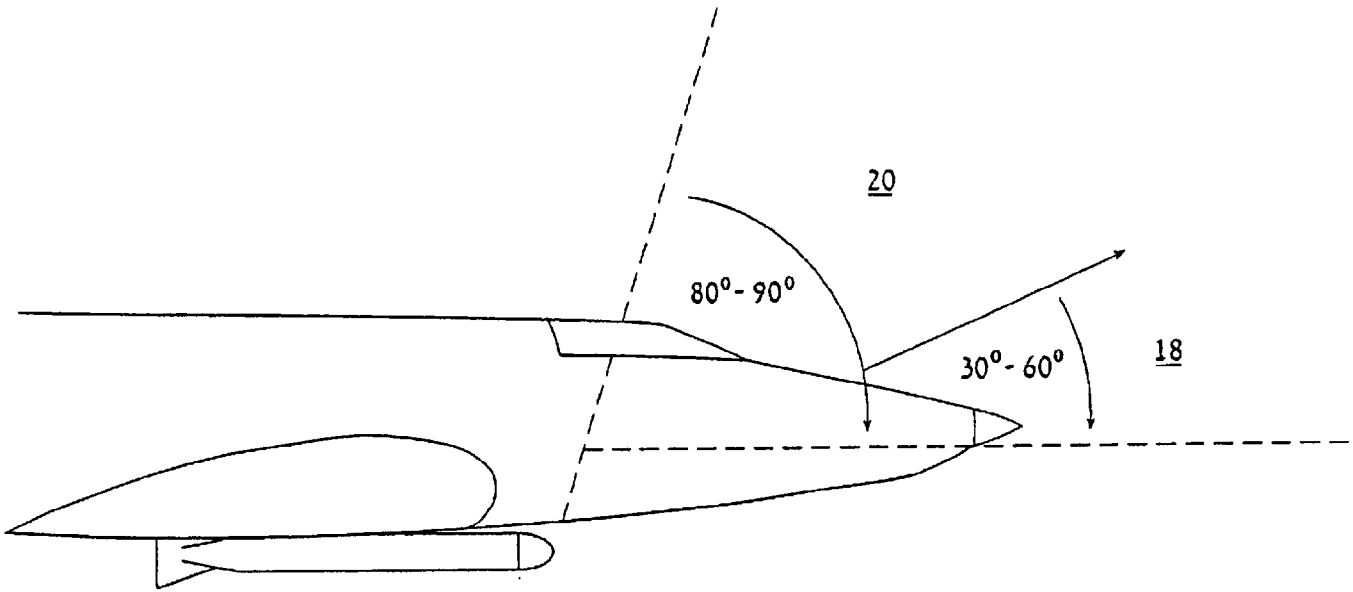
FIG. 2 is a schematic side view of an aircraft illustrating the respective fields-of-view of a missile seeker and a radar system.
Figure 3:
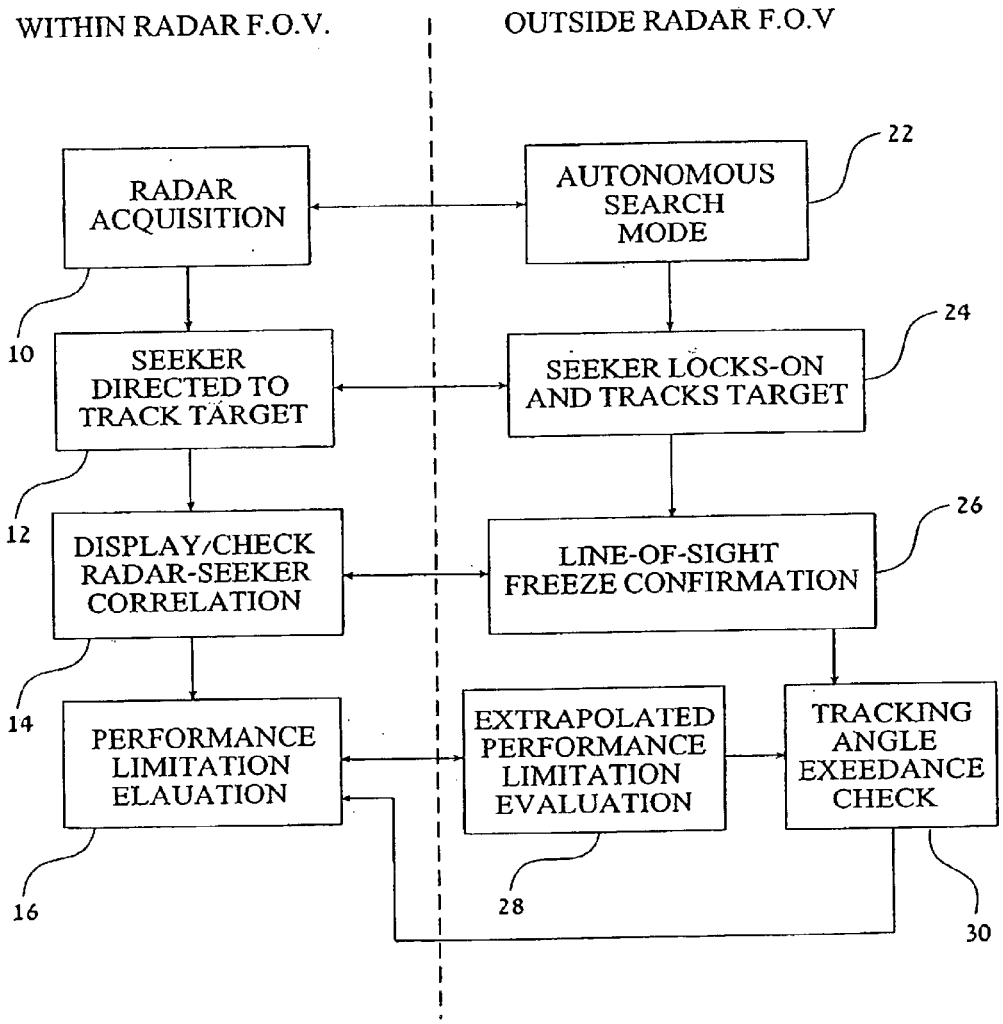
FIG. 3 is a flow diagram illustrating the main elements of a preferred implementation of a method for operating an air-to-air missile according to the teachings of the present invention.

Referring now to the drawings, FIG. 3 shows an overview of operation of a preferred implementation of the present invention in which the aforementioned radar-based modes of operation (10, 12, 14, 16) are complemented by a number of additional modes of operation which provide highly effective functionality for operating the missile in cases where a target lies outside the field-of-view of the radar.

Specifically, the additional modes of operation include at least one autonomous search mode 22 in which the missile seeker performs an autonomous search within at least one predefined region outside the radar field-of-view and, when a target is detected, locks-on to and tracks the target (step 24). A further mode 26 provides a verification procedure, allowing the pilot to verify that the tracked target corresponds to a specific target visible to the pilot. An extrapolated performance limitation evaluation check 28 provides continuing information regarding the ability of a missile to reach the target, even after the target has left the radar field-of-view, and a tracking angle exceedance check 30 provides one critical indication relating to the ability of the missile to reach the target even in cases where insufficient information is available for a full performance limitation evaluation.

It is believed that the aforementioned additional modes are particularly useful as an integrated group of modes, together offering operational functionality with respect to targets outside the radar field-of-view which approaches that of targets within the radar field-of-view. At the same time, it should be appreciated that each of the additional modes described herein may be useful individually as part of various other systems, as will be clear to one ordinarily skilled in the art. By way of a non-limiting example, the modes will be described herein in the context of a preferred integrated system.

Furthermore, although the present invention will be described herein as complementing radar-based modes of operation, it should be noted that modes 22, 24, 26 and 30 may be used to advantage in aircraft which do not have a radar system, or in which the radar system has been intentionally or unavoidably deactivated.

It will be noted that the additional modes of operation according to the present invention are preferably implemented as "autonomous" or, in the case of extrapolated performance limitation evaluation check 28, "semi-autonomous" modes. In this context, it should be noted that the term "autonomous" is used herein to refer to a mode of operation in which a given operation of the missile does not require input from radar-based information systems onboard the aircraft Similarly, the term "semi-autonomous" is used to refer to a mode of operation which, while employing inputs from radar-based information systems, can continue to operate if the relevant information becomes unavailable. In a further matter of terminology, reference will be made to a "boresight direction". The boresight direction is defined to be the direction in a frame of reference moving with an aircraft which corresponds to the direction of flight during constant speed, level flight under windless conditions. In more intuitive terms, this is the "straight ahead" direction of the aircraft. In most cases, this boresight direction may also be assumed to be the "straight ahead" direction of a missile as mounted on the aircraft.

Figure 4:
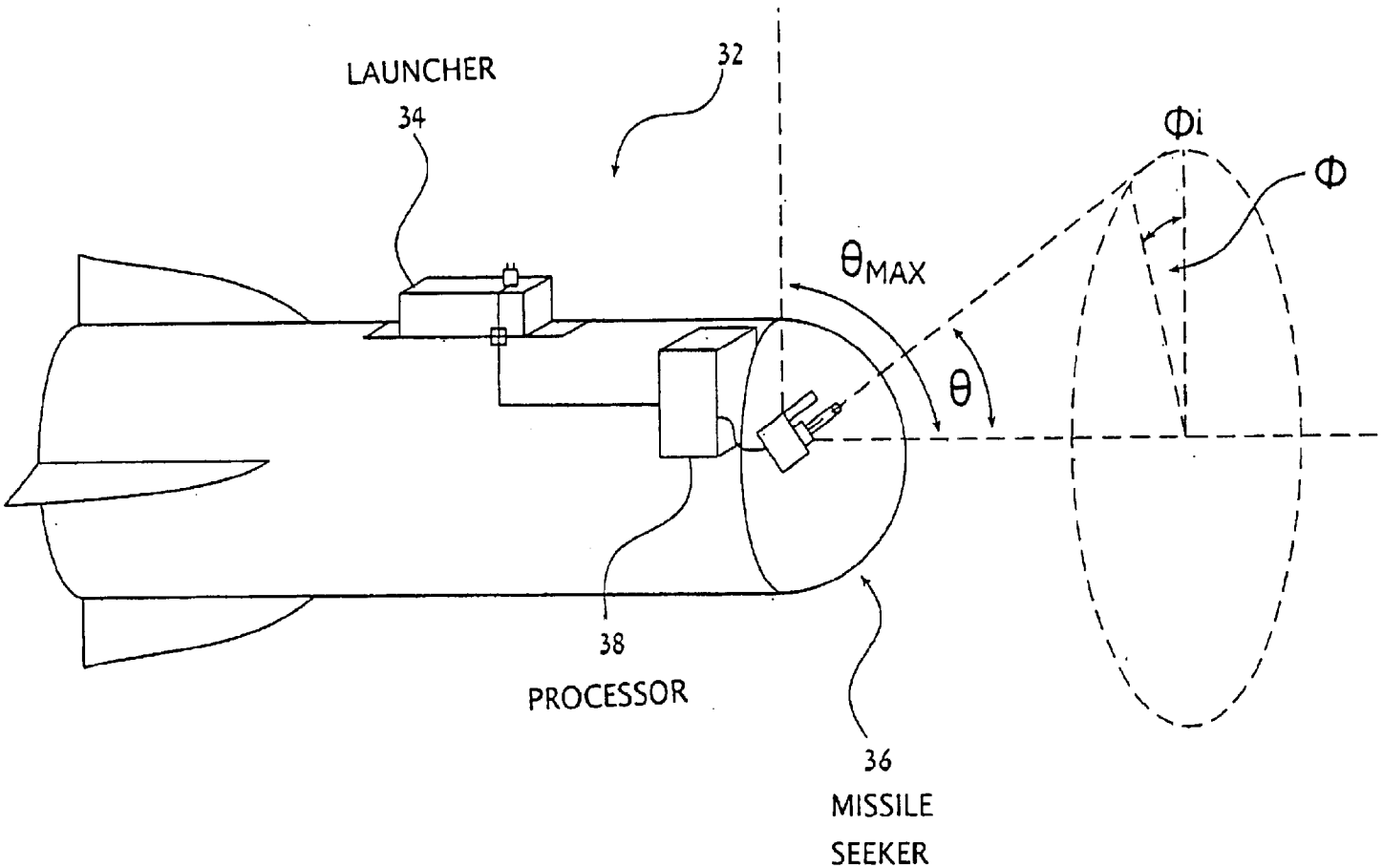
FIG. 4 is a schematic isometric view of a missile, constructed and operative according to the teachings of the present invention.

Referring now to FIG. 4, there is shown schematically a short range, air-to-air missile 32, constructed and operative according to the teachings of the present invention. Missile 32 is adapted to be carried by an aircraft via a launcher 34, thereby defining an orientation of the missile relative to the aircraft. Missile 32 includes a gimbaled seeker 36 which has a direction of regard defined by an angle of inclination $\theta$ from the boresight direction and an orientation angle $\phi$ measured about an axis corresponding to the boresight direction. The missile also includes a processing system 38 including at least one processor associated with seeker 36.

It is a preferred feature of the present invention that one or more of the additional modes to be described are implemented using processing system 38 mounted within the missile. It should be noted that the processing system of target seeking air-to-air missiles typically has very considerable computational capabilities, being designed to control the missile propulsion and steering systems very rapidly in response to real-time input from the seeker and under conditions of very high relative speeds between the missile and target. During tracking operations while still attached to the aircraft, these computational capabilities are typically greatly underused. Accordingly, it is therefore a preferred feature of the present invention that some or all of the additional modes described below are implemented using the processing system of the missile. This offers a further advantage in that the additional modes of the missile may be provided with little or no reprogramming of the complex onboard computer systems, instead linking to the aircraft information and sound-channel networks in a standard or near-standard manner.

Turning now to the features of autonomous search mode 22, this actuates missile seeker 36 to perform a predefined scanning pattern so as to search for a target within at least one predefined region. The predefined region is preferably aircraft-specific, being redefined for each type of aircraft to complement the capabilities of the aircraft radar system, if present. According to one option, the predefined region corresponds to the entire part of the seeker field-of-view which lies outside the radar field-of-view. In this case, however, the extent of the region to be scanned may be too large to offer an acceptable scanning frequency. More preferably, the choice of size and position of the predefined region additionally takes into consideration target position assumptions based upon common combat scenarios.

Figure 5:
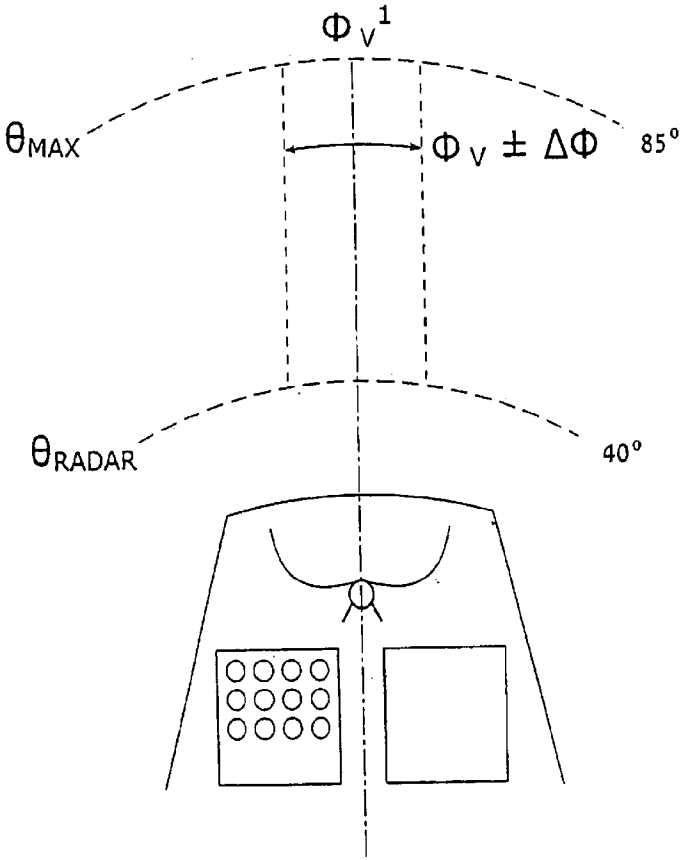
FIG. 5 is a schematic view from the cockpit of an aircraft illustrating the principles of an autonomous search mode according to the teachings of the present invention.

In one most preferred example, schematically illustrated in FIG. 5, the predefined region is chosen to provide an extended "vertical mode" in which the missile seeker scans a region viewed as "up" by the pilot beyond the inclination which can be monitored by the radar system. Thus, the scanning search pattern covers a range of inclination angles starting from the maximum angle of the radar and spanning no less than 30°. In the case of a radar system which can reach inclination angles of up to about 60°, an additional 30° is typically sufficient to complete the missile seeker field-of-view. In cases where the radar field-of-view is limited to inclination angles of up to about 30°, the scanning search pattern preferably covers a range of inclination angles spanning no less than 50°. In all cases, it is most preferred that the radar and the missile seeker search together substantially span the field-of-view of the seeker in the "up" direction up to $\theta_{max}$. Where no radar system is present, the scanning search pattern alone preferably substantially spans the field-of-view of the seeker up to $\theta_{max}$.

As mentioned earlier, the "vertical mode" is intended for situations in which the pilot tries to pull up the aircraft nose towards a target. As a result, the target position is generally approximately central over the head of the pilot. This allows the scanning search pattern to be confined to a range of orientation angles spanning no more than 20°, thereby rendering the total region to be scanned relatively small so that the entire scanning cycle can be completed quickly. In most cases, the width of the scanning search pattern is preferably reduced to no more than 10°, and most preferably lies in the range of 5°–10°. In each case, this range is preferably distributed symmetrically about a central orientation angle $\phi_v$ corresponding to a vertically "up" direction in the frame of reference of the pilot.

Clearly, this "vertical mode" is one of a large number of different search regions which could be defined according to the particular requirements of an aircraft and its anticipated combat situations. For example, in the case of rotary-wing aircraft, the combat scenarios are typically very different, requiring different definitions of the predefined search region. Optionally, more than one search region may be predefined, corresponding to different pilot-selectable search modes.

It will be understood that mode 22 qualifies as "autonomous" according to the above definition in that it performs a search within a predefined region, i.e., a region defined in advance without any information relating to target position such as would be provided by a radar system or other cueing/aiming device.

Actuation of the independent search mode may be performed manually by the pilot, such as by providing a dedicated actuation control (button or the like). Alternatively, and particularly in a case that the independent search mode complements a specific search mode of the radar system, the independent search mode may be automatically invoked when the pilot selects the corresponding mode of the radar system.

Once search mode 22 has started, it typically continues until a target is acquired or until otherwise canceled by the pilot. If a target is found, the seeker then switches automatically to tracking mode 24, continuing to track the target. An audible signal typically indicates to the pilot that a target is being tracked.

Turning now to verification mode 26, this allows the pilot to verify that the tracked target corresponds to a specific target visible to the pilot without requiring use of a head-up or helmet-mounted display. The mode operates by providing a distinctive indication to the pilot when a rate of angular motion of seeker 36 falls below a given value for a predefined period.

Structurally, processor 38 is preferably suitably programmed so as to provide a signaling unit configured to provide a first indication to the pilot when the seeker is tracking a target and to provide a second indication to the pilot when a rate of angular motion of the seeker falls below a given value for a predefined period.

Figure 6:
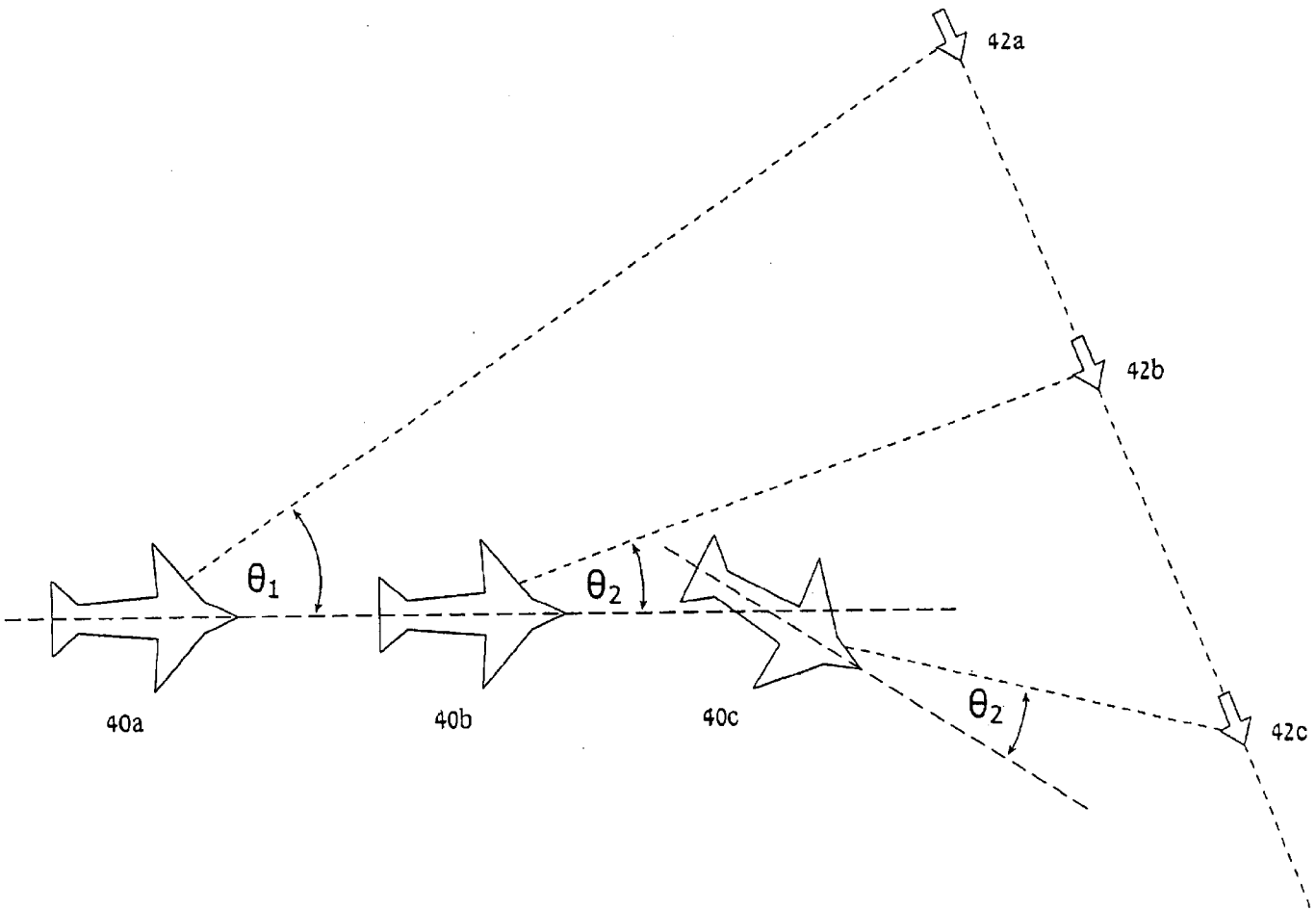
FIG. 6 is a schematic plan view of an aircraft and a target illustrating the principles of a line-of-sight freeze confirmation mode according to the teachings of the present invention.

The operation of this mode will be better understood with reference to a schematic exaggerated example illustrated in FIG. 6. This shows an aircraft in a first position 40*a* when a target is at a first position 42*a*. By the time the aircraft has reached position 40*b*, the target has reached position 42*b*. During this period, the target is viewed by the pilot, and by the missile seeker, as advancing from left to right. As a result, the inclination angle $\theta$ of the seeker changes from $\theta_1$ at position 40*a* to $\theta_2$ and position 42*b*.

In order to verify that the seeker is locked-on to the correct target, the pilot then flies the aircraft in such a manner that the direction of a line of sight from the pilot to the target remains substantially constant in a frame of reference moving with the aircraft for the predefined period. In other words, the pilot flies the aircraft so that the target appears to remain still in the cockpit window (canopy). Thus, in this case, the pilot turns the aircraft to the right 40*c* so as to briefly maintain the inclination angle of the seeker substantially constant at $\theta_2$ as the target advances to 42*c*. Although not shown in this two-dimensional representation, the pilot also compensates for any variations in the orientation angle $\phi$. This causes the signaling unit to generate the second indication, thereby confirming to the pilot that the target being tracked corresponds to the target of interest.

As stated above, the second indication is generated when the rate of angular motion of seeker 36 falls below a given value for a predefined period. The choice of parameters used to define these conditions may vary considerably, but should satisfy two conditions: firstly, the parameters should be sufficient to define a state which is significantly more "stationary" than the great majority of targets; and secondly, the degree of steadiness required to fall within the range defined by the parameters should be within the capabilities of most pilots, even under conditions of stress. In a preferred implementation, the given value of the rate of angular motion is no more than about 5° per second, and preferably between about 2° and about 4° per second. The predefined period is preferably no more than a second, and preferably about half a second.

It will be appreciated that an erroneous target verification would be produced during level flight in the event that the seeker were to be locked-on to a very distant target. Optionally, such a verification can be avoided by disabling the second indication when flight information made available to the missile through the onboard information network indicates that the aircraft is on a straight level course.

Preferably, the aforementioned first and second indications are provided as readily distinguishable audible signals which are provided to the pilot through connection to a sound channel, as is known in the art.

Turning now to extrapolated performance limitation evaluation check 28, this provides continuing information regarding the ability of a missile to reach the target, even after the target has left the radar field-of-view.

As mentioned earlier, it is known to perform various performance limitation checks by evaluating performance limitation criteria relating to the ability of the missile to reach a given target when a given target lies within the radar field-of-view These criteria are typically complicated calculations employing range-derived data including the range of the target, the speed and direction of motion of the target relative to the aircraft, and the acceleration vector of the target. This data is referred to a "range-derived data" since it is derived, at least in part, from range information provided by the radar system. This range-derived data is supplemented by data from other aircraft systems relating to the airspeed and angle of attack of the aircraft Based upon this data, together with previously stored data defining the performance capabilities of the missile, the various criteria provide a highly reliable overall prediction of the capability of the missile to reach the target. Details of these calculations are known in the art and will not be discussed here.

It is a particular feature of mode 28 that evaluation of these performance limitation criteria continues during a period subsequent to the given target leaving the radar field-of-view by using approximate range-derived data derived by extrapolation from range-derived data provided previously by the radar system.

Various models may be used for extrapolating the range-derived data. One particularly preferred model is based upon a constant target speed assumption. While a target is within the radar field-of-view, the true target velocity can be derived from relative velocity information in combination with information from the aircraft flight systems regarding the aircraft velocity. In almost all cases, it is reasonable to assume that the speed of a target will not vary significantly over a period of up to about 20 seconds. This assumption, together with tracking direction information provided by seeker 36 and aircraft velocity information from the flight systems, is generally sufficient to allow meaningful extrapolation of all required range-derived data for the given target.

The period for which evaluation continues based upon extrapolated data is preferably chosen to be at least five seconds, and is preferably no more than twenty seconds. If extended significantly beyond twenty seconds, the extrapolated data will in many cases differ significantly from the real values such that the evaluation becomes unreliable.

Here too, it is a preferred feature of the present invention that the evaluation of the performance limitation criteria is performed, at least during the period when the target is outside the radar field-of-view, by processing system 38 located within the missile. Given that processing system 38 is thus programmed to perform these calculations, the evaluation while within the radar field-of-view may advantageously also be performed using processing system 38.

It is a further preferred feature of the present invention, applicable even in the context of an otherwise conventional radar-based system for evaluating missile performance limitation criteria, that a further distinct audible indication to the pilot is selectively generated dependent upon results of the evaluation. This audible indication may altogether replace the visual display of conventional systems, or may be provided as a supplement thereto. In the context of preferred implementations employing mode 28, the audible indication is provided both for targets within and beyond the radar field-of-view. The use of an audible indication makes the performance limitation check information readily and intuitively available to the pilot while avoiding any unnecessary burden on his attention such as results from interpretation of a dedicated visual display.

The audible indication may be a negative warning (a buzzer or the like) indicative of a tracked target lying outside the effective range of the missile, or may be a supplementary positive indication accompanying the basic "currently tracking" signal to indicate that the tracked target is within range. During periods that the target is within the radar field-of-view, this audible indication is preferably additionally indicative of the presence, or lack, of correlation between the missile tracking direction and the line-of-sight from the radar system to the target.

Turning finally to tracking angle exceedance check 30, this provides one critical indication relating to the ability of the missile to reach the target even in cases where insufficient information is available for a full performance limitation evaluation. This mode is preferably invoked when mode 28 is terminated at the end of a predefined period, or when no previous radar data is available such as for targets found by search mode 22 which have not entered the radar field-of-view.

Figure 7:
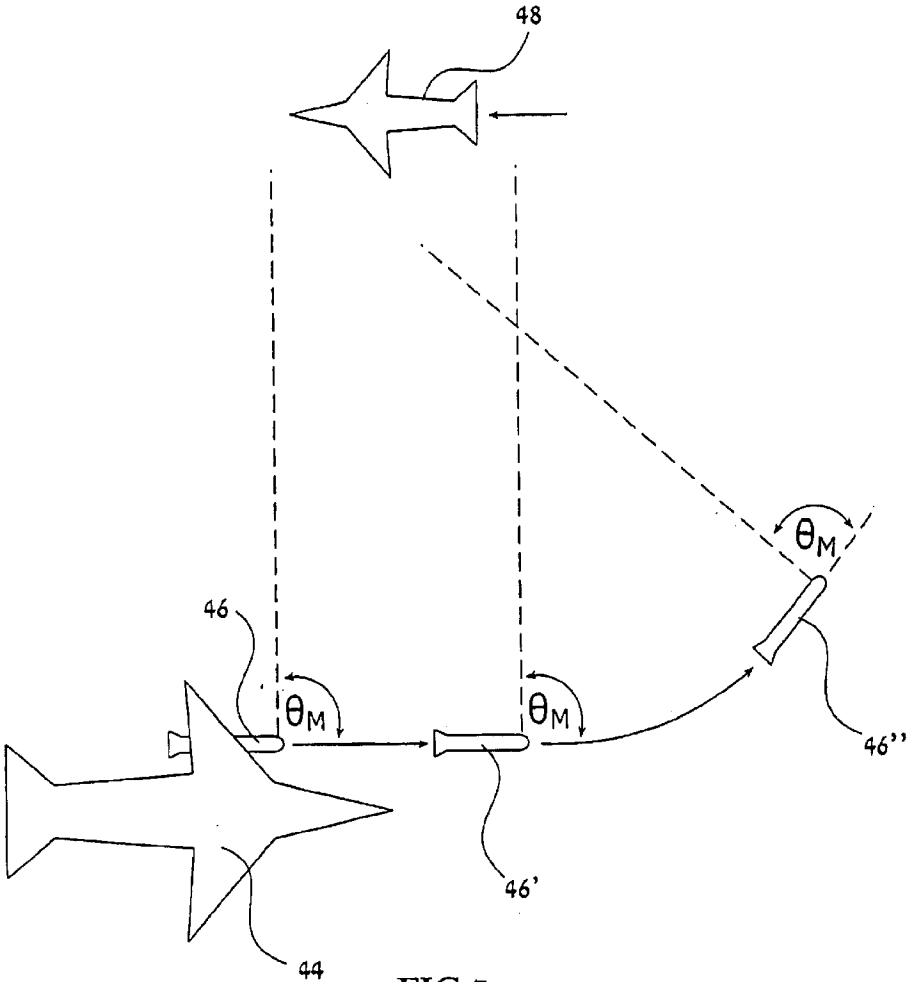
FIG. 7 is a schematic plan view of an aircraft, a missile and a target illustrating the principles underlying a tracking angle exceedance check according to the teachings of the present invention.

The problem addressed by tracking angle exceedance check 30 may be understood with reference to FIG. 7. Here there is shown an aircraft 44 carrying a missile 46 which is currently tracking a target 48. Also illustrated are two subsequent positions of the missile designated 46' and 46" which correspond to the maximum possible turn of the missile. It will be noted that, for safety reasons, the missile does not begin to turn until it has traveled straight ahead sufficiently to distance itself from aircraft 44. This fact, together with the significant response time taken to actuate the missile propulsion system and launch the missile, typically results in a delay of close to a second between the fire command and the missile starting to turn.

As a result of this delay, although target 48 lies within the range and kinematic capabilities of missile 46, the missile will fail to reach the target due to interruption of tracking of the target. Specifically, by the time the missile reaches position 46', target 48 is outside the seeker field-of-view, causing the target to be lost.

In order to provide a warning of likely failure due to tracking angle exceedance, the angle of inclination of seeker 36 is processed while the seeker is tracking the target to derive a rate of change of the angle of inclination $\dot{\theta}$. An off-boresight tracking angle limitation parameter is then evaluated as a function of both the angle of inclination and the rate of change. If the off-boresight tracking angle limitation parameter falls outside a predefined range, a tracking angle exceedance signal is generated.

Figure 8:
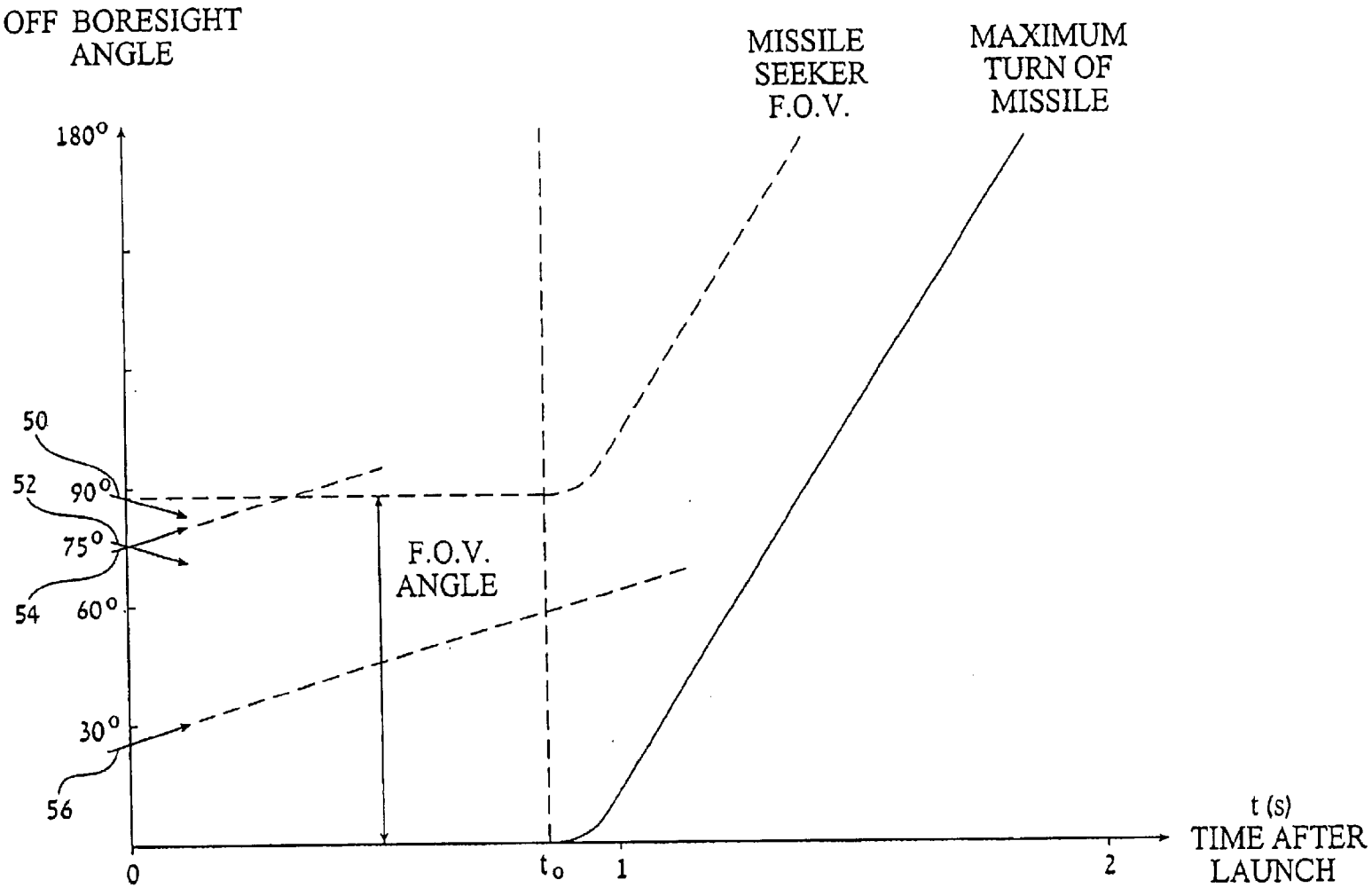
FIG. 8 is a graph of off-boresight angle against time after firing illustrating a preferred implementation of the tracking angle exceedance check according to the teachings of the present invention.

A simple preferred implementation of this mode may be better understood with reference to FIG. 8. This graph illustrates the maximum angle of turn of the missile as a function of time after firing, and the corresponding field-of-view (F.O.V.) of the missile seeker.

On the same graph, a number of targets 50, 52, 54 and 56 are each represented by a current off-boresight angle $\theta$ and a slope corresponding to the rate of change $\dot{\theta}$. Targets 50 and 52, despite their proximity to the limit of the field-of-view, are both predicted to remain within the field-of-view after firing. Target 54, on the other hand, is expected to leave the field-of-view before the missile can turn, therefore giving rise to a tracking angle exceedance signal. Target 56, despite its considerable rate of increase in angle, is seen to be currently still within the tracking limitations.

Mathematically, this linear extrapolation calculation is equivalent to evaluating an off-boresight tracking angle limitation parameter P according to a relation $P=\theta+t_0\dot{\theta}$ where $t_0$ is a predefined measure of time taken after firing for the missile to begin to turn. The tracking angle exceedance signal is then generated for cases in which P is greater than $\theta_{max}$.

While this calculation is generally sufficient in cases of level flight, it is preferably modified where the aircraft has a significant angle of attack to account for the tendency of the missile to align itself with the airstream immediately after launch. In such cases, the tracking angle limitation parameter is evaluated asymmetrically taking into consideration the angle of attack and airspeed provided by the aircraft flight systems. Specifically, the maximum permitted tracking angle beyond the angle of attack may be reduced by 1–2 times the current angle of attack. In lateral directions, the calculation is unaffected.

Here too, it is a preferred feature of the present invention that the off-boresight tracking angle exceedance check is performed by processing system 38 located within the missile.

Once again, the tracking angle exceedance signal is preferably generated as an electric signal corresponding to a distinctive audio output. In this context, it should be noted that the various audible indications provided by modes 26, 28 and 30 need not necessarily all be distinct. By way of example, in many cases it may be preferred to combine all available indications of the ability of the missile to reach the target in a single "shoot cue" tone. Thus, when the target is within the field-of-view of the radar system, the shoot cue is only sounded if the conventional performance limitation criteria evaluation 16 indicates that the missile is capable of reaching the target and, in addition, a correlation criterion indicates that there is correlation between the missile tracking direction and the line-of-sight from the radar system to the target. If the target leaves the radar field-of-view, the shoot cue tone is produced so long as the extrapolated performance limitation criteria 28 are satisfied. In circumstances where the extrapolated performance limitation criteria 28 are not available, the shoot cue tone is no longer generated Nevertheless, the absence of a warning tone from the tracking angle exceedance check 30 indicates to the pilot that the maximum tracking angle of the missile will not be exceeded if the missile is now fired. From the pilot's point of view, this implementation provides seamless continuity between the different modes, at all times offering the pilot the best available indication of the ability of the missile to reach the target.

According to a further optional feature of the present invention, a fire-disable device (not shown) may be deployed to prevent launch of the missile when one or more of the modes provide an indication that the missile will fail to reach the target.

Finally, it should also be noted that the audible indication from verification mode 26 also need not be distinct from all other tones. For example, when verification mode 26 is intended only to be employed after a target is acquired through the "vertical mode" implementation of search mode 22, the performance limitation criteria indications of modes 16 and 28 will inherently not be available. Accordingly, the same audible indication (tone) may be used for both The fact that the tone starts and stops according to the line-of-sight freeze observed by the pilot is sufficient to avoid any confusion.

It will be appreciated that the above descriptions are intended only to serve as examples, and that many other embodiments are possible within the spirit and the scope of the present invention as defined by the appended claims.

What is claimed is:

1. A method for providing indications to a pilot operating a short range, air-to-air missile carried by an aircraft flown by the pilot, the missile having a seeker operative to track a target, the method comprising:

(a) providing a first indication to the pilot when the seeker is tracking a target; and (b) providing a second indication to the pilot when a rate of angular motion of the seeker falls below a given value for a predefined period.

2. The method of claim 1, wherein said first indication and said second indication are readily distinguishable audible signals.

3. A method for providing indications to a pilot operating a short range, air-to-air missile carried by an aircraft flown by the pilot, the missile having a seeker configured to track a target, the method comprising:

(a) providing a signaling unit associated with the missile and configured to provide a first indication to the pilot when the seeker is tracking a target and to provide a second indication to the pilot when a rate of angular motion of the seeker falls below a given value for a predefined period; and (b) while the seeker is tracking a target visible to the pilot, flying the aircraft in such a manner that a rate of angular motion of the direction of a line of sight from the pilot to the target remains below said given value in a frame of reference moving with the aircraft for said predefined period, thereby causing said signaling unit to generate said second indication.

4. The method of claim 3, wherein said first indication and said second indication are readily distinguishable audible signals.

5. A short range, air-to-air missile to be carried by an aircraft flown by a pilot, the missile comprising:

(a) a gimbaled seeker for tracking a target;

(b) a processing system including at least one processor, said processing system providing a first indication to the pilot when the seeker is tracking a target;

wherein said processing system further provides a second indication to the pilot when a rate of angular motion of the seeker falls below a given value for a predefined period.

6. The missile of claim 5, wherein said first and second indications are provided by generating corresponding readily distinguishable audible signals.

7. A short range, air-to-air missile to be carried by an aircraft flown by a pilot, the missile comprising:

(a) a gimbaled seeker for tracking a target, said gimbaled seeker having a direction of regard defined by an angle of inclination $\theta$ from a predefined boresight direction and an orientation angle $\phi$ measured about an axis corresponding to said boresight direction, said angle of inclination $\theta$ being limited by a predefined maximum angle $\theta_{max}$; and (b) a processing system including at least one processor associated with said seeker, said processing system to:

(i) processing said angle of inclination while said seeker is tracking a target to derive a rate of change of said angle of inclination $\dot{\theta}$, (ii) evaluating an off-boresight tracking angle limitation parameter as a function of both said angle of inclination and said rate of change, and (iii) generating a tracking angle exceedance signal when said off-boresight tracking angle limitation parameter falls outside a predefined range.

8. The missile of claim 7, wherein said processing system evaluates said off-boresight tracking angle limitation parameter P according to a relation $P=\theta+t_0\dot{\theta}$ where $t_0$is a predefined measure of time taken after firing for the missile to begin to turn, and wherein said processing system generates said tracking angle exceedance signal when P is greater than $\theta_{max}$.

9. The missile of claim 7, wherein said processing system generates said tracking angle exceedance signal as an electric signal corresponding to a distinctive audio output.

10. A short range, air-to-air missile to be carried by an aircraft flown by a pilot, the missile comprising:

(a) a gimbaled seeker having a direction of regard defined by an angle of inclination $\theta$ from a predefined boresight direction and an orientation angle $\phi$ measured about an axis corresponding to said boresight direction; and (b) a processing system including at least one processor associated with said seeker, said processing system for:

(i) selectively actuating said seeker to perform a scanning search pattern for a target, said scanning search pattern being confined to a range of orientation angles spanning no more than 20° and covering a range of inclination angles spanning no less than 30°, and (ii) when a target is found, causing said seeker to track the target.

11. The missile of claim 10, wherein said scanning search pattern covers a range of inclination angles spanning no less than 50°.

12. The missile of claim 10, wherein said angle of inclination $\theta$ is limited by a predefined maximum angle $\theta_{max}$, said scanning search pattern covering a range of inclination angles extending substantially up to said predefined maximum angle $\theta_{max}$.

13. The missile of claim 10, wherein said scanning search pattern is confined to a range of orientation angles spanning no more than 10°.

14. The missile of claim 10, wherein said scanning search pattern is confined to a range of orientation angles spanning between 5° and 10°.

15. The missile of claim 10, further comprising attachment features defining an orientation of attachment of the missile to an aircraft such that, when attached to an aircraft, a given value of seeker orientation angle $\phi_v$ corresponds to a "vertical" direction in an aircraft frame of reference, wherein said scanning search pattern is confined to a range of orientation angles of $\phi_v \pm 5°$.

16. A method for operating a short range, air-to-air missile carried by an aircraft flown by a pilot, the missile including a gimbaled seeker having a direction of regard defined by an angle of inclination $\theta$ from a predefined boresight direction and an orientation angle $\phi$ measured about an axis corresponding to the boresight direction, the method comprising:

(a) causing said seeker to perform a scanning search pattern for a target, said scanning search pattern being confined to a range of orientation angles spanning no more than 20° and covering a range of inclination angles spanning no less than 30°, and (b) when a target is found, causing said seeker to track the target.

17. The method of claim 16, wherein said scanning search pattern covers a range of inclination angles spanning no less than 50°.

18. The method of claim 16, wherein said angle of inclination $\theta$ is limited to a predefined maximum angle $\theta_{max}$, said scanning search pattern covering a range of inclination angles extending substantially up to said predefined maximum angle $\theta_{max}$.

19. The method of claim 16, wherein said scanning search pattern is confined to a range of orientation angles spanning no more than 10°.

20. The method of claim 16, wherein said scanning search pattern is confined to a range of orientation angles spanning between 5° and 10°.

21. The method of claim 16, wherein said scanning search pattern is confined to a range of orientation angles of $\phi_v$ ±5°where $\phi_v$ corresponds to a vertical direction in the aircraft frame of reference.

22. A method for providing indications to a pilot operating a short range, air-to-air missile carried by an aircraft flown by the pilot, the missile including a gimbaled seeker having a direction of regard defined by an angle of inclination $\theta$ from a predefined boresight direction and an orientation angle $\phi$ measured about an axis corresponding to the boresight direction, the angle of inclination $\theta$ being limited by a predefined maximum angle $\theta_{max}$, the method comprising:

(a) processing the angle of inclination while the seeker is tracking a target to derive a rate of change of the angle of inclination $\dot{\theta}$;

(b) evaluating an off-boresight tracking angle limitation parameter as a function of both said angle of inclination and said rate of change; and (c) generating a tracking angle exceedance signal when said off-boresight tracking angle limitation parameter falls outside a predefined range.

23. The method of claim 22, wherein at least said steps of processing and evaluating are performed by a processing system located within the missile.

24. In an aircraft carrying a short range, air-to-air missile having a seeker for tracking a target within a missile field-of-view, the aircraft including a radar system which provides range-derive data relating to targets within a radar field-of-view smaller than the missile field-of-view, a method for evaluating whether the missile will be effective in reaching a target comprising the steps of:

(a) during a first period when a given target lies within the radar field-of-view, evaluating at least one performance limitation criterion relating to the ability of the missile to reach the given target, the performance limitation criterion being evaluated using the range-derived data for the given target; and (b) during a second period subsequent to the given target leaving the radar field-of-view, evaluating the performance limitation criterion using approximate range-derived data for the given target, said approximate range-derived data being derived by extrapolation from range-derived data provided by the radar system during the first period.

25. The method. of claim 24, wherein said approximate range-derived data is derived by extrapolation based upon an assumption that a speed of the given target derived from radar measurements during a latter portion of the first period remains constant.

26. The method of claim 24, wherein said second period is at least five seconds.

27. The method of claim 24, wherein said second period is less than twenty seconds.

28. The method of claim 24, wherein the performance limitation criterion is additionally evaluated using target direction information related to a direction from the aircraft to the given target, wherein said target direction information is derived, at least during said second period, from tracking information provided by the missile seeker.

29. The method of claim 24, wherein said evaluating is performed, at least during said second period, by a processing system located within the missile.

30. The method of claim 24, further comprising selectively generating, dependent upon results of evaluating said at least one performance limitation criterion, an audible indication audible to a pilot of the aircraft.

* * * * *